US009793035B2

(12) United States Patent
Sakurai et al.

(10) Patent No.: US 9,793,035 B2
(45) Date of Patent: Oct. 17, 2017

(54) SOFT MAGNETIC METAL POWDER AND SOFT MAGNETIC METAL POWDER CORE USING THE SAME

(71) Applicant: TDK CORPORATION, Tokyo (JP)

(72) Inventors: Yu Sakurai, Tokyo (JP); Tomofumi Kuroda, Tokyo (JP); Hideyuki Itoh, Tokyo (JP)

(73) Assignee: TDK CORPORATION, Tokyo (JP)

( * ) Notice: Subject to any disclaimer, the term of this patent is extended or adjusted under 35 U.S.C. 154(b) by 190 days.

(21) Appl. No.: 14/712,326

(22) Filed: May 14, 2015

(65) Prior Publication Data

US 2015/0332824 A1 Nov. 19, 2015

(30) Foreign Application Priority Data

May 14, 2014 (JP) ..... 2014-100330
Jan. 29, 2015 (JP) ..... 2015-015580

(51) Int. Cl.

| | |
|---|---|
| ***H01F 1/20*** | (2006.01) |
| ***C22C 38/02*** | (2006.01) |
| ***H01F 1/24*** | (2006.01) |
| ***H01F 41/02*** | (2006.01) |
| ***H01F 1/147*** | (2006.01) |

(Continued)

(52) U.S. Cl.

CPC ..... *H01F 1/20* (2013.01); *C22C 33/0257* (2013.01); *C22C 38/00* (2013.01); *C22C 38/002* (2013.01); *C22C 38/02* (2013.01); *H01F 1/14766* (2013.01); *H01F 1/24* (2013.01);

(Continued)

(58) Field of Classification Search

CPC ..... H01F 1/20; H01F 1/14766; H01F 1/24; H01F 41/0246; C22C 38/00; C22C 38/002; C22C 38/02; C22C 33/0257; B22F 2999/00

See application file for complete search history.

(56) References Cited

U.S. PATENT DOCUMENTS 5,800,636 A 9/1998 Tsukada et al.
7,285,329 B2 * 10/2007 Kaneko ..... B22F 1/0062 428/403

(Continued)

FOREIGN PATENT DOCUMENTS

CN 101892425 A 11/2010
CN 103339694 A 10/2013

(Continued)

OTHER PUBLICATIONS

Hitachi et al., JP 61253301, published Nov. 1986. Machine translation.*

(Continued)

*Primary Examiner* — Keith Walker
*Assistant Examiner* — John Hevey
(74) *Attorney, Agent, or Firm* — Oliff PLC

(57) ABSTRACT

The present invention relates to a soft magnetic metal powder which has Fe as the main component and contains Si and B, wherein, the content of Si in the soft magnetic metal powder is 1 to 15 mass %, the content of boron inside the metal particle of the soft magnetic metal powder is 10 to 150 ppm, and the particle has a film of boron nitride on the surface. The present invention also relates to a soft magnetic metal powder core prepared by using the soft magnetic metal powder.

7 Claims, 1 Drawing Sheet

(51) Int. Cl.
*C22C 38/00* (2006.01)
*C22C 33/02* (2006.01)

(52) U.S. Cl.
CPC ..... *B22F 2998/10* (2013.01); *B22F 2999/00* (2013.01); *H01F 41/0246* (2013.01)

(56) References Cited

U.S. PATENT DOCUMENTS

| | | | | |
|---|---|---|---|---|
| 8,123,874 | B2 * | 2/2012 | Ishimine | B22F 1/0014 148/306 |
| 2013/0277601 | A1 | 10/2013 | Kurita et al. | |
| 2015/0332821 | A1 * | 11/2015 | Sakurai | H01F 1/1475 252/62.55 |
| 2015/0332823 | A1 * | 11/2015 | Sakurai | H01F 1/147 75/244 |

FOREIGN PATENT DOCUMENTS

| | | | | |
|---|---|---|---|---|
| EP | 1568427 | A1 | 8/2005 | |
| JP | 61253301 | * | 11/1986 | B22F 1/00 |
| JP | H09-260126 | A | 10/1997 | |
| JP | 2002-057020 | A | 2/2002 | |
| JP | 2004-253697 | A | 9/2004 | |
| JP | 2004-259807 | A | 9/2004 | |
| JP | 2005-200286 | A | 7/2005 | |
| JP | 2005-281786 | A | 10/2005 | |
| JP | 2008-189950 | A | 8/2008 | |
| JP | 2010-156054 | A | 7/2010 | |
| JP | 2010-236021 | A | 10/2010 | |
| JP | 2011-054924 | A | 3/2011 | |
| JP | 2014-192454 | A | 10/2014 | |

OTHER PUBLICATIONS

Tokoro, Hisato et al. "Iron Nanoparticles Coated With Boron Nitride Nanolayers Synthesized by a Solid Phase Reaction," IEEE Transactions on Magnetics, vol. 39, No. 5, pp. 2761-2763, 2003.

Oct. 2, 2015 Extended Search Report issued in European Patent Application No. 15167359.7.

Feb. 9, 2016 Notification of Reason for Rejection issued in Japanese Application No. 2015-015580.

* cited by examiner

SOFT MAGNETIC METAL POWDER AND SOFT MAGNETIC METAL POWDER CORE USING THE SAME

The present invention relates to a soft magnetic metal powder used for the powder core or the like and also relates to a soft magnetic metal powder core.

BACKGROUND

The ferrite core, the stacked electromagnetic steel plate, the soft magnetic metal powder core (the core prepared by a mold forming process, an injection molding process or a sheet molding process, etc.) and the like may be used as the magnetic core material for a reactor or an inductor, wherein, the reactor or the inductor is to be utilized in the application where a large current is to be applied. The stacked electromagnetic steel plate has a high saturated magnetic flux density, but the iron loss becomes higher when the driving frequency of the power supply exceeds tens of kilohertz (kHz) which causes a decreased efficiency. On the other hand, although the ferrite core is a magnetic core material with a low loss at a high frequency, it has a low saturated magnetic flux density, leading to a large size.

The soft magnetic metal powder core is becoming widespread because it has less iron loss at a high frequency than the stacked electromagnetic steel plate and also has a larger saturated magnetic flux density than the ferrite core. However, although its loss is less than that of the stacked electromagnetic steel plate, the loss is not that low as the ferrite has. The loss is expected to be lower.

It is well known that in order to decrease the loss of the soft magnetic metal powder core, the coercivity of the soft magnetic metal powder which forms the core should be decreased. There are two types of losses in the core, i.e., the hysteresis loss and the eddy current loss. As the hysteresis loss depends on the coercivity, the loss in the core can be decreased if the coercivity is lowered. The larger the grain size of the soft magnetic metal powder is, the lower the coercivity of the soft magnetic metal powder is. In order to enlarge the grain size of the soft magnetic metal powder (i.e., in order to enable the grains grow), a thermal treatment needs to be applied to the soft magnetic metal powder at a high temperature at which the grains can grow. However, if the thermal treatment is performed at such a high temperature, a problem rises that the soft magnetic metal powder particles are sintered and adhered to each other.

Therefore, Patent Document 1 has disclosed a technique in which an inorganic powder for preventing sintering is mixed to the iron powder and then a thermal treatment is applied at a high temperature. In Patent Document 2, a technique has been disclosed that an inorganic insulator is mixed in the soft magnetic alloy powder to prevent the powder from adhering to each other while a thermal treatment is performed at a high temperature.

PATENT DOCUMENTS

Patent Document 1: JP-A-H9-260126
Patent Document 2: JP-A-2002-57020

SUMMARY

In the technique disclosed in Patent Document 1 or Patent Document 2, a mass of inorganic powder is mixed to perform the thermal treatment at a high temperature in order to prevent the soft magnetic metal powder from sintering.

However, the inorganic powder cannot uniformly cover the surface of each soft magnetic metal particle without any voids, so the adhesion cannot be avoided in the metal powder if a thermal treatment is provided at a temperature of 1000° C. or higher. The adhered metal powder needs a pulverization treatment so that strains are introduced. As a result, the coercivity is not small enough in the finally obtained soft magnetic metal powder. To prevent the soft magnetic metal powder from adhering, the upper limit of the temperature is 950° C. in the thermal treatment, at which the growth of the grain is not sufficient. That is, in the prior art, the effect on the growth of the grains is not sufficient. In this respect, it is hard to say that the coercivity is sufficiently decreased in the obtained soft magnetic metal powder. Also, another problem exists that the loss is also increased in the soft magnetic metal powder core prepared by using this soft magnetic metal powder.

The present invention is provided to solve the problems mentioned above. It aims to improve the coercivity of the soft magnetic metal powder and also reduce the loss in the soft magnetic metal powder core which uses the soft magnetic metal powder.

In order to solve the technical problems mentioned above, the soft magnetic metal powder of the present invention is characterized in that it contains Si and B and further has iron as the main component, wherein the content of Si is 1 to 15 mass % in the soft magnetic metal powder, the content of B is 10 to 150 ppm inside the metal particle of the soft magnetic metal powder, and a film of boron nitride is provided on the surface of the mentioned metal powder particle.

The soft magnetic metal powder can have a decreased coercivity by being prepared to have the structure mentioned above.

More preferably, the soft magnetic metal powder of the present invention is characterized in that the content of Cr in the mentioned soft magnetic metal powder is 1 to 10 mass %.

By being prepared to have the structure mentioned above, the coercitivy of the soft magnetic metal powder can be substantially kept constant. In the meanwhile, the electrical resistance can be increased and a rust prevention can be provided.

More preferably, the soft magnetic metal powder of the present invention is characterized in that among the metal particles constituting the soft magnetic metal powder in the present invention, the roundness of the cross-section is 0.80 or more in 90% or more of the metal particles.

The soft magnetic metal powder can have a further decreased coercivity by being prepared to have the structure mentioned above.

More preferably, the soft magnetic metal powder of the present invention is characterized in that the metal particle consists of a single grain in 90% or more of the metal particles.

The soft magnetic metal powder can have a further decreased coercivity by being prepared to have the structure mentioned above.

More preferably, the soft magnetic metal powder of the present invention is characterized in that the content of oxygen contained in the soft magnetic metal powder is 500 ppm or less.

The soft magnetic metal powder can have a further decreased coercivity by being prepared to have the structure mentioned above.

The soft magnetic metal powder core of the present invention is a kind of soft magnetic metal powder core prepared by using the soft magnetic metal powder of the present invention.

The loss of the core is extremely low in the soft magnetic metal powder core prepared by using the soft magnetic metal powder of the present invention.

The soft magnetic metal powder core of the present invention is characterized in that it is a kind of soft magnetic metal powder core prepared by using the soft magnetic metal powder of the present invention and the content of boron nitride in the soft magnetic metal powder core is 50 to 4790 ppm.

The soft magnetic metal powder core prepared by using the soft magnetic metal powder of the present invention has an extremely low loss and a high permeability.

According to the present invention, a soft magnetic metal powder having a low coercivity can be obtained. By using such a soft magnetic metal powder, the loss can be reduced in the soft magnetic metal powder core.

DETAILED DESCRIPTION OF EMBODIMENTS

Figure 1:
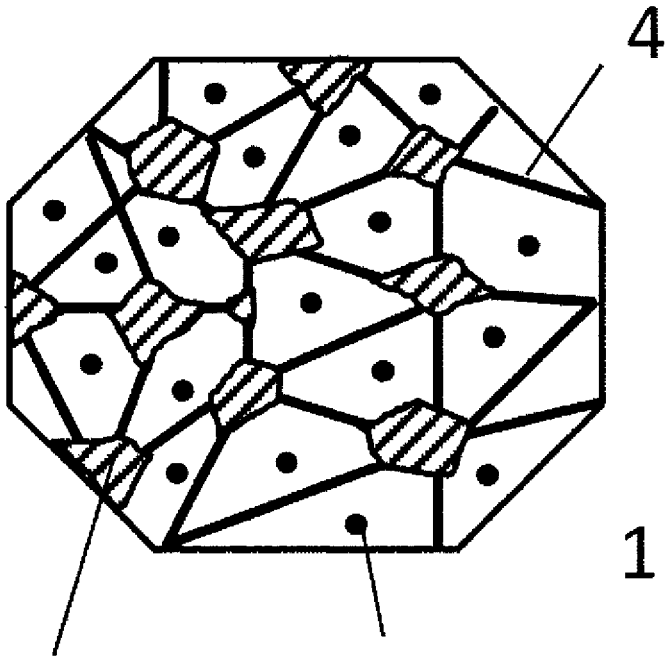
FIG. 1 is a schematic diagram showing the cross-section of a particle of the starting material powders in the present invention.

The soft magnetic metal powder of the present invention is characterized in that the soft magnetic metal powder particle has a film of boron nitride on its surface and the content of B inside the metal particle of the soft magnetic metal powder is 10 to 150 ppm. It has been found that these characteristics lead to a low coercivity. The soft magnetic metal powder having the structure of the present invention can be obtained by using a starting material powder with B added in the particles.

In the soft magnetic metal material having iron as the main component, B is known as an element for forming the amorphous structure. In order to prepare an amorphous metal material, a large quantity of B (2 mass % or more) is added into the soft magnetic metal material containing iron. In addition, it is necessary to form the amorphous structure at one time during the preparation process in order to produce a soft magnetic metal material with a nano-crystalline structure, so a large quantity of B is to be added. However, for the general crystalline soft magnetic metal material containing iron (which is neither an amorphous metal material nor a soft magnetic metal material with a nano-crystalline structure), the heterogeneous phase having a high magnetocrystalline anisotropy such as $Fe_2B$ and FeB or the like is formed to increase the coercivity, so B is not considered to be added. Nevertheless, it has been found in the present invention that a soft magnetic metal powder having a low coercivity can be obtained by adding B in the crystalline soft magnetic metal material containing iron.

The mechanism will be described on how the soft magnetic metal powder of the present invention has a low coercivity. There are two main reasons for the low coercivity in the present invention. One reason is that a film of boron nitride is formed on the surface of the soft magnetic metal powder particle. The other reason is that a trace of B (10 to 150 ppm) is contained in the metal particles of the soft magnetic metal powder. First of all, the effect brought by the film of boron nitride will be described.

In the prior art, the micro-particles of oxides and/or nitrides which are mixed to prevent sintering during the thermal treatment at a high temperature are not capable of entirely covering the surface of the metal particles and thus are unevenly distributed or are unstable at a high temperature. Thus, a problem rises that the metal particles adhere to each other in the thermal treatment at a high temperature of 1000° C. or more so that powder cannot be obtained. A technique is studied here to solve such a problem and the present invention is completed accordingly. In particular, in the technique, a boron nitride film which has a high melting point and a rather low reactivity with metal even at a high temperature is used to cover the whole surface of the soft magnetic metal powder particles.

The ultimate problem in the prior art lies in the material that constitutes the part (a powder or a film) outside the soft magnetic metal powder for preventing sintering. In the process, the distribution of the material for preventing sintering on the surface of each metal particle will inevitably become uneven. Thus, it is considered that an even and stable layer for preventing sintering can be formed by making the component contained inside the metal particle diffuse to and precipitate on the surface and then reacting the component with the atmospheric gas on the surface of the metal particle. Therefore, in the present invention, a starting material powder which has iron as the main component and contains Si and B is prepared, and the starting material powder is subjected to a thermal treatment at a high temperature under a non-oxidative atmosphere containing nitrogen. Through this thermal treatment at a high temperature, B in the mentioned starting material powder particle can diffuse to the surface of the metal particles and then react with nitrogen on the surface of the metal particle to form a film of boron nitride which uniformly covers the whole surface of the metal particle. In this way, the metal particles will not adhere to each other so that they can be subjected to a thermal treatment at a high temperature.

Figure 2:
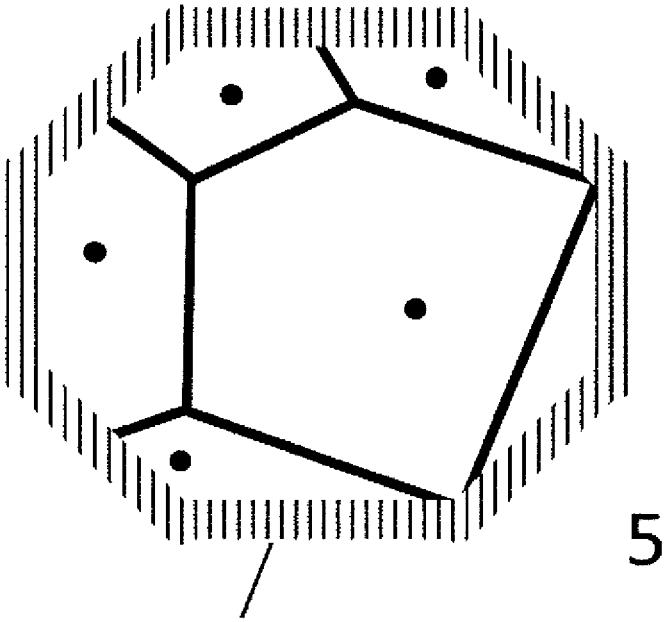
FIG. 2 is a schematic diagram showing the cross-section of the soft magnetic metal powder of the present invention.

FIG. 1 exemplarily shows the configuration of the cross-section of a starting material powder particle, and FIG. 2 exemplarily shows the configuration of the cross-section in a soft magnetic metal powder particle. As a large quantity of B is added to the starting material power particle shown in FIG. 1, $Fe_2B$ phase segregates in the grain boundary besides some B dissolved as solid solute in the metallic parent phase. In this respect, no material for preventing sintering has been formed on the surface of the metal particles. On the surface of the soft magnetic metal powder particle shown in FIG. 2, a film of boron nitride is formed to cover the whole surface of the metal particle uniformly. A uniform film without any void can be formed by containing a sufficient content of B in the starting material powder particles and then azotizing B to form the film of boron nitride. By forming the uniform film without any void, the contact between the surfaces of the starting material powder particles can be prevented. In the mixture obtained by mixing the powder of oxides such as $SiO_2$, $Al_2O_3$ or $B_2O_3$ or the powder of nitrides such as boron nitride in the starting material powder, the contact between the surfaces of the starting material powder particles cannot be completely inhibited even a large quantity of oxide powder or nitride powder is mixed in the starting material powder. In addition, boron nitride is more chemically stable against metals compared to the oxides, and it itself is a substance hard to be sintered. Thus, when a thermal treatment at a high temperature is performed, the metal particles are adhered to each other via oxides in the case of the film of oxides while no adhesion will occur in the case of the film of boron nitride. The boron nitride has a lower density than the metal starting material powder, so there will be an effect of expanding the distance between the adjacent surfaces of the metal part of the starting material powder particles if a film of boron nitride is formed on the surface of the starting material powder particle. Such an action is also effective in preventing the starting material powder particles from sintering. Based on the effects mentioned above, a thermal treatment can be done at a high temperature of 1000° C. or more which cannot be performed in the prior art. In addition, the coercivity can be lowered.

The other main reason for the low coercivity in the present invention concerns the effect produced by the trace of B (10 to 150 ppm) contained in the metal particle of the soft magnetic metal powder. Hereinafter, this effect will be described.

The $Fe_2B$ phase disappears from the interior of the particle in the soft magnetic metal powder particle shown in FIG. 2, and 10 to 150 ppm of B is dissolved as solid solute in the metallic parent phase. The grain size of the metal particle of the soft magnetic metal powder becomes larger than that in the starting material powder particle shown in FIG. 1. If a thermal treatment is applied to the metal powder at a high temperature, the grains will grow even if there is no 10 to 150 ppm of B dissolved as solid solute in the metallic parent phase. However, it is discovered that if 10 to 150 ppm of B is dissolved as solid solute in the metallic parent phase, the growth of grains will be promoted. It may be due to the diffusion of B from the interior of the starting material powder particle to the surface of the starting material powder particle so that movement of the grain boundary towards the direction of the surface of the starting material powder particle becomes easy and the grain growth is promoted. As B is added to the starting material powder, B exists even at the central part of the starting material powder particle. Thus, when the thermal treatment is performed at a high temperature, the grains around the central part of the starting material powder particle effectively overgrow. However, as shown in FIG. 1, when the starting material powder particle contains at its interior intermetallic compounds such as $Fe_2B$, the intermetallic compounds such as $Fe_2B$ are eccentrically distributed at the grain boundary. As a result, the movement of the grain boundary accompanying with the diffusion of B towards the surface of the starting material powder particle is blocked and the grain growth is almost stopped. As shown in FIG. 2, if the content of B is 10 to 150 ppm in the metal particle of the soft magnetic metal powder, the intermetallic compounds such as $Fe_2B$ are little or if the content of B is as infinitesimal as that no such intermetallic compound is formed, the effect on promoting the grain growth will be evident. Two effects will be obtained by containing B in the starting material powder particles, i.e., to form a good sintering-preventing film which is heat resistant and also to promote the growth of grains. Further, a soft magnetic metal powder having an extremely low coercivity can be obtained.

Hereinafter, the embodiments of the present invention will be described.

(With Respect to the Characteristic of the Soft Magnetic Metal Powder of the Present Invention)

The soft magnetic metal powder of the present invention contains Si and B and has iron as the main component. The content of B inside the metal particle of the soft magnetic metal powder is 10 to 150 ppm, and the metal particle of the soft magnetic metal powder has a film of boron nitride on its surface. When the content of B of the metal particle of the soft magnetic metal powder is 10 to 150 ppm, the coercivity becomes sufficiently low. If 150 ppm or more of B is contained in the metal particle of the soft magnetic metal powder, the ferromagnetic phase with a big magnetocrystalline anisotropy such as $Fe_2B$ and the like will be formed and the growth of grains is inhibited, which both are the reasons why the coercivity deteriorates. If the starting material powder is subjected to a thermal treatment at a high temperature under a non-oxidative atmosphere containing nitrogen, the mass of B inside the starting material powder particle will be azotized on the surface of the metal particle to form boron nitride. As a result, it is quite easy to control the content of B to be 10 to 150 ppm inside the metal particle of the soft magnetic metal powder. If the content of B inside the metal particle of the soft magnetic metal powder is 10 to 150 ppm, B diffuses towards the surface of the metal particle during the thermal treatment at a high temperature so that the growth of grains can be promoted and the coercivity can be reduced. Since several ppm of B is dissolved as solid solute in the bcc phase of the parent phase in the metal particle of the soft magnetic metal powder and the diffusion rate decreases as the concentration of B in the metal particle becomes lower, it is hard to control the content of B to be 10 ppm or less inside the metal particle of the soft magnetic metal powder. The content of Si of the soft magnetic metal powder is adjusted to be 1 to 15 mass %. If the content of Si is less than 1 mass %, the magnetocrystalline anisotropy or the magnetostriction constant becomes large and cannot obtain a good soft magnetic property. If the content of Si is more than 15%, the coercivity becomes higher or the hardness of the soft magnetic metal powder becomes much too high. Thereby, when it is made into a soft magnetic metal powder core, the density of the powder core will become much too low so a good soft magnetic metal powder core cannot be obtained.

More preferably, 1 to 10% of Cr is added to the composition of the soft magnetic powder of the present invention. With the 1 to 10% of Cr added, the coercivity will not be damaged and a good rust prevention can be provided to the soft magnetic metal powder particle. Further, another effect can be provided that the electrical resistance is increased in the soft magnetic metal powder particle so that the eddy current loss can be decreased when this powder is prepared as a soft magnetic metal powder core. If less than 1% of Cr is added, the effects on providing the rust prevention and increasing the electrical resistance will be lessened. The effect on the rust prevention does not change even more than 10% of Cr is added but the saturation magnetization decreases in proportion to the content of added Cr. Thus, the upper limit for the content of added Cr is 10%.

In the present invention, the content of B inside the metal particle of the soft magnetic metal powder can be quantified by using an ICP. When the content of B is quantified, the boron nitride attached to the surface of the metal particle of the soft magnetic metal powder should be completely removed; otherwise the content of boron inside the metal particle of the soft magnetic metal powder cannot be accurately quantified. Thus, a treatment such as ball milling is applied to the soft magnetic metal powder or a pulverized powder to remove the boron nitride attached to the surface of the metal particle of the soft magnetic metal powder, wherein the pulverized powder is obtained by pulverizing the magnetic powder core which utilizes the soft magnetic metal powder using a pestle and a mortar. Then, the boron nitride peeled off is rinsed away from the soft magnetic metal powder. Alternatively, an acid is applied to the surface of the metal particle of the soft magnetic metal powder to slightly dissolve the surface and thus to free and then rinse away the boron nitride attached to the surface of the metal particle. With the methods mentioned above, boron nitride is separated from the soft magnetic metal powder, and then the ICP is used to quantify the remaining soft magnetic metal powder. Alternatively, as boron nitride does not dissolve in acids, an acid such as nitric acid or hydrochloric acid or the like can be added to the soft magnetic metal powder or the magnetic powder core using the soft magnetic metal powder so as to dissolve the metallic component. In this way, the indissoluble boron nitride is separated. Then, the obtained solution is quantified by using an ICP.

The boron nitride contained in the soft magnetic metal powder of the present invention or the magnetic powder core using the soft magnetic metal powder of the present invention can be tested by using an XRD. After the boron nitride attached to the surface of the soft magnetic metal powder particle is removed by performing processes such as ball milling for the soft magnetic metal powder or the pulverized powder of the magnetic powder core using the soft magnetic metal powder, boron nitride is rinsed, collected and dried. Then, the XRD is used in the analysis so as to test boron nitride. Alternatively, as boron nitride does not dissolve in acids, an acid such as nitric acid or hydrochloric acid or the like can be added to the soft magnetic metal powder or the powder core using the soft magnetic metal powder so as to dissolve it. The indissoluble component is collected and analyzed by using the XRD to test boron nitride. Alternatively, the content of boron nitride in the soft magnetic metal powder or the powder core using the soft magnetic metal powder can be quantified based on the content of B and that of nitrogen. The ICP is used to measure the content of B of the soft magnetic metal powder or the core using the soft magnetic metal powder, and a value is calculated by deducting the content of B inside the soft magnetic metal powder particle from the value obtained above. The content of nitrogen of the soft magnetic metal powder or the core using the soft magnetic metal powder is measured via a device such as an oxygen/nitrogen analyzer (TC600, produced by LECO Corporation). Then, the sum of these two values will be deemed as the content of boron nitride.

In the soft magnetic metal powder of the present invention, if the roundness of the cross-section in the metal particle is controlled to be 0.80 or more in 90% or more of the metal particles of the soft magnetic metal powder, a soft magnetic metal powder with further lowered coercivity can be obtained. The soft magnetic metal powder or the pulverized powder of the powder core using the soft magnetic metal powder is fixed by using a cold mounting and embedding resin and then cut to show a cross-section which is later mirror polished. In this way, the shape of the cross-section of the metal particle can be observed. At least 20, preferably 100 such prepared cross-sections of the metal particles are randomly observed, and the roundness is measured in each metal particle. The roundness defined by Wadell can be used as one example of the roundness. In particular, it is defined as the ratio of the diameter of the circle with an area equal to the projected area of the cross-section of the metal particle to the diameter of the Circumscribed circle of the cross-section of the metal particle. If it is a perfect circle, the Wadell roundness is 1. The closer the roundness gets to 1, the rounder the circle is. If the roundness is 0.80 or more, the shape can be substantially deemed as spherical. The observation can be carried out via an optical microscope or an SEM while the roundness can be calculated based on the image analysis.

In the present invention, a soft magnetic metal powder with a low coercivity can be obtained if the metal particle consists of one single grain in 90% or more of the metal particles constituting the soft magnetic metal powder. If sufficient thermal treatment at a high temperature is applied to the soft magnetic metal particle of the present invention, the soft magnetic metal powder with 90% or more of the metal particles in the soft magnetic metal powder being formed by one single grain each can be obtained. The temperature and the time to last during the thermal treatment at a high temperature change depending on the particle size of the soft magnetic metal powder and the amount of pores inside the metal particle. The thermal treatment at a high temperature can be performed at 1200° C. or higher for 60 minutes or more. The soft magnetic metal powder or the pulverized powder of the powder core using the soft magnetic metal powder is fixed by using the cold mounting and embedding resin and then cut to show a cross-section which is later mirror polished. Then, the soft magnetic metal powder is etched by Nital (ethanol+1% of nitric acid) so that the grain boundary can be observed. At least 20, preferably 100 or more such prepared cross-sections of the metal particles are observed randomly. If the metal particle where no grain boundary is observed is counted as one metal particle consisting of one single grain, then 90% or more of the metal particles observed consist of one single grain each. There are still a part of metal particles whose grain growth is not sufficient in the thermal treatment, so not all the metal particles consist of one single grain. The observation can be done through an optical microscope or an SEM (scanning electron microscope).

In the present invention, a soft magnetic metal powder having a low coercivity can be further obtained by containing 500 ppm or less of oxygen in the soft magnetic metal powder. The content of oxygen in the soft magnetic metal powder can be controlled to be 500 ppm or less by performing the thermal treatment at a reducing atmosphere.

The soft magnetic metal powder of the present invention preferably has an average particle size of 1 to 200 μm. If the average particle size is less than 1 μm, the permeability of the soft magnetic metal powder core will decrease. On the other hand, if the average particle size exceeds 200 μm, the eddy current loss inside the particle will increase in the soft magnetic metal powder core.

(With Respect to Starting Material Powder)

The method for preparing the starting material powder of the soft magnetic metal powder is not particularly restricted. For example, methods such as the water atomization method, the gas atomization method and the casting-pulverizing method can be used. The gas atomization method is preferable because it is easy to provide a soft magnetic metal powder with 90% or more of the metal particles in the soft magnetic metal powder having a roundness of 0.80 or more at the cross-section of the metal particle.

The starting material powder is a kind of metal powder consisting of an iron alloy with iron as the main component, and it also contains Si and B. The content of Si in the starting material powder is adjusted to be 1 to 15 mass %. The content of B in the starting material powder is 0.1 mass % or more and 2.0 mass % or less. If the content is less than 0.1 mass %, it is unlikely to form a uniform film of boron nitride without any void because the contained B is too less. In this respect, the metal particles will be sintered together during the thermal treatment at a high temperature. The more the content of B is in the starting material powder, the heavier burden the thermal treatment carries in order to control the content of B inside the soft magnetic powder particle to be 150 ppm or less. Thus, the content of B should be controlled at 2.0 mass % or less.

(With Respect to Thermal Treatment)

The starting material powder containing B is subjected to a thermal treatment at a high temperature under a non-oxidative atmosphere containing nitrogen. Since the strain is released and the growth of grains is started by the thermal treatment, the particle size of the grain becomes larger. In order to sufficiently reduce the coercivity, the thermal treatment is carried out at a non-oxidative atmosphere containing nitrogen at a temperature of 1000 to 1500° C. for 30 to 600 minutes with a heating rate of 5° C./min or less. With such a thermal treatment, B in the starting material powder will react with the nitrogen in the atmospheric gas so that a film of boron nitride is formed on the surface of the metal particle and the grain of the starting material powder particle is set to grow. When the temperature during the thermal treatment is lower than 1000° C., the azotization reaction of the boron in the starting material powder is not sufficient. In this way, the ferromagnetic phase such as $Fe_2B$ and the like will remain so the coercivity will not sufficiently decrease. In addition, the growth of the grain in the starting material powder is not sufficient any more. In another respect, if the temperature is higher than 1500° C. during the thermal treatment, the azotizing will proceed quickly to the end of the reaction. Also, the grains quickly grow to be single-crystallized. Thus, no effect will be produced even if the temperature is raised to a level above the mentioned one. The thermal treatment at a high temperature is performed at a non-oxidative atmosphere containing nitrogen. Actually, the thermal treatment is performed at the non-oxidative atmosphere to inhibit the oxidation of the soft magnetic metal powder. If the temperature rises too quickly, the temperature will reach a level where the staring material powder particles are sintered before sufficient amount of boron nitride is generated, and the starting material powder will be sintered. Therefore, the heating rate of the temperature is controlled to be 5° C./min or less.

The starting material powder is filled in a container such as a crucible or a saggar. The container should be made of a material that will not deform at a high temperature of 1500° C. and will not react with metals. A continuous furnace such as a pusher furnace or a roller hearth furnace; a batch furnace such as a box furnace, a tube furnace, a vacuum furnace or the like can be used as the furnace for thermal treatment.

(With Respect to Soft Magnetic Metal Powder Core)

As the soft magnetic metal powder provided in the present invention exhibits a low coercivity, the loss becomes lower when it is used to prepare the soft magnetic metal powder core. In the method for preparing the soft magnetic metal powder core, the soft magnetic metal powder can use a powder prepared by a general preparation method besides the powder obtained in the present invention. An example is shown here.

A resin is mixed in the soft magnetic metal powder of the present invention to prepare particles. The resin can be the epoxy resin or the silicone resin, preferably a resin that has a shape-retention property during the molding process and an electric insulating property and can be uniformly coated on the surface of the soft magnetic metal powder particle. The obtained particle is filled in a mold with a desired shape, and then a press molding process is applied to provide a molded article. The pressure for molding can be properly selected depending on the composition or the desired density of the soft magnetic metal powder. It probably ranges from 600 to 1600 MPa. If needed, a lubricant can be used. The obtained molded article is prepared to be a powder core by a thermal curing process. Alternatively, a thermal treatment can be provided in order to release the strain produced during the molding process, and a soft magnetic metal powder core is obtained accordingly. The temperature is 500 to 800° C. during the thermal treatment, and the treatment is preferably carried out at a non-oxidative atmosphere such as the nitrogen atmosphere or the argon atmosphere.

(With Respect to the Grinding Treatment to Film of Boron Nitride)

When the soft magnetic metal powder of the present invention is used to prepare the soft magnetic metal powder core, the film of boron nitride formed on the surface of the metal particle of the soft magnetic metal powder in the present invention may be ground to reduce the content of boron nitride contained in the soft magnetic metal powder core. The boron nitride is a non-magnetic component and will not affect the coercivity of the powder at all. Further, as the boron nitride is an insulator, the film of boron nitride will also function as an insulating film for preventing the metal particles from conducting when the soft magnetic metal powder of the present invention is used to prepare the powder core. However, if the soft magnetic metal powder contains a large quantity of boron nitride, the permeability of the core will decrease when the powder is made into the soft magnetic metal powder core. Therefore, the boron nitride is removed from the soft magnetic metal powder by grinding the film of boron nitride, and then the powder is used to prepare the soft magnetic metal powder core. As a result, a soft magnetic metal powder core can be provided with a high permeability. The method for grinding the film of boron nitride can be ones shown below. In particular, the film of boron nitride is ground by a ball mill to peel off the boron nitride film. Alternatively, an acid is applied to dissolve only the outermost part of the soft magnetic metal powder particle to peel off the boron nitride from the surface of the metal particle of the soft magnetic metal powder. Then an air classification or a sieve is used to separate the peeled off boron nitride. Or the film of boron nitride can be rinsed away by using an alcohol or water. When preparing the soft magnetic powder core, resins are covered on the surface of the particle to provide the particle with a shape-retention property and the insulativity. Thus, after the film of boron nitride is ground, it is not necessary for the boron nitride on the surface of the metal particle of the soft magnetic metal powder to keep being a uniform film. That is, the boron nitride can be dispersedly distributed on the surface of the metal particle of the soft magnetic metal powder as speckles. The permeability of the soft magnetic metal powder core will be large enough if the content of boron nitride in the soft magnetic metal powder is controlled to be 4790 ppm or less. As the film of boron nitride on the surface of the metal particle of the soft magnetic metal powder firmly adheres to the surface of the metal particle, the ball milling treatment should be performed for a long time to remove the film completely. In this case, strain will be produced in the soft magnetic metal powder, and the coercivity will deteriorate. Alternatively, the soft magnetic metal powder can be immersed in an acid for a long time to dissolve the soft magnetic metal powder particle so as to peel off the boron nitride. However, the soft magnetic metal powder will rust, and the coercivity will deteriorate. In this respect, the soft magnetic metal powder should contain 50 ppm or more of boron nitride. If the content of boron nitride is 50 ppm or more, the coercivity will not be damaged due to the grinding treatment of the boron nitride film.

The preferable embodiments of the present invention have been described above, but the present invention is not limited to these embodiments. Various modifications can be made in the present invention without departing from the spirit and scope.

EXAMPLES

Example 1

Evaluation on Content of Boron, Roundness, Grain Size and Content of Oxygen in Soft Magnetic Metal Powder and Evaluation on Powder Core The starting material powder was prepared via a preparation method shown in Table 1 with the additive amount of B, the content of Si and Cr also shown in Table 1. The particle size of the starting material powder was adjusted by a sieving process to have an average particle sized of 20 μm. The powder was filled in a crucible made of alumina which was later put into a tube furnace and subjected to a high-temperature thermal treatment under the nitrogen atmosphere at a temperature for a period of time, wherein both of the temperature and the period of time were shown in Table 1. The temperatures for the thermal treatment in Comparative Example 1-32 or 1-33 were used to study the upper limit of the temperature at which no sintering will occur. The result was 900° C. (Examples 1-1 to 1-3, Comparative Examples 1-4 to 1-6, Examples 1-7 to 1-10, Comparative Example 1-11, Examples 1-14 to 1-31, and Comparative Examples 1-32 and 1-33).

For each Example and Comparative Example, ICP was used to quantify the content of B inside the metal particle of the soft magnetic metal powder. After thermal treatment, the soft magnetic metal powder was placed into a poly bottle, and the medium of zirconia with a diameter of 3 mm and ethanol were added thereto. Then, a ball milling treatment was performed for 1440 minutes and the boron nitride on the surface of the soft magnetic metal powder particle was peeled off. After the medium was removed, the sheet of boron nitride which was peeled off from the soft magnetic metal powder was rinsed by ethanol. The ICP was used to quantify the content of B in the metal particle of the soft magnetic metal powder from which boron nitride had been separated.

The powder of each Example or Comparative Example was fixed by the cold mounting and embedding resin, and then cross-sections were cut and then mirror polished. A hundred cross-sections of the metal particles were observed randomly and the roundness defined by Wadell was measured for each metal particle. Then the percentage occupied by the metal particles with a roundness of 0.80 or more was calculated. The results were shown in Table 1.

The powder of each Example or Comparative Example was fixed by the cold mounting and embedding resin, and then cross-sections were cut and mirror polished. Then, Nital (ethanol+1% of nitric acid) was used to etch the mirror polished cross-section of the metal particle. The grain boundaries were observed in 100 randomly selected metal particles, and the percentage occupied by the metal particles each consisting of one single grain was calculated. The result was shown in Table 1.

An oxygen-nitrogen analyzer (TC600, produced by LECO Corporation) was used to quantify the content of oxygen contained in the powder of each Example and Comparative Example.

The coercivity of the powder was tested for each Example and Comparative Example. The coercivity of the powder was tested by the following method. In particular, 20 mg of powder was put into a plastic case of ϕ6 mm×5 mm, and paraffin was further added thereto. The paraffin was melted and then solidified to fix the powder, and the fixed powder was measured by using a coercivity meter (K-HC1000, Tohoku Steel Co., Ltd). The magnetic field in test was 150 kA/m. The results were shown in Table 1.

The film of boron nitride was ground for the powder of each Example and Comparative Example. The soft magnetic metal powder was put into a poly bottle, and the medium of zirconia having a diameter of 3 mm was added thereto together with ethanol. Then, a ball milling treatment was performed for 120 minutes and the boron nitride on the surface of the soft magnetic metal powder particle was peeled off. After the medium was removed, the sheet of boron nitride which was peeled off from the soft magnetic metal powder was rinsed by ethanol. The ball milling was respectively performed for 300 minutes, 600 minutes and 10 minutes in Examples 1-30, 1-31 and 1-34.

Powder cores were prepared using the powder from each Example or Comparative Example. Relative to 100 mass % of soft magnetic metal powder, 2.4 mass % of silicone resin was added. The mixture was mixed with a kneader and then subjected to a finishing process with a mesh of 355 μm to prepare particles. The resultant particles were filled into a toroidal mold having an outer diameter of 17.5 mm and an inner diameter of 11.0 mm, and a molding pressure of 980 MPa was applied to provide a molded article. The core was 5 g in weight. A thermal treatment was applied to the obtained molded article at 750° C. in nitrogen atmosphere for 30 minutes in a belt furnace to provide a powder core.

The permeability and the loss of the core were evaluated for the obtained powder cores. The permeability and the loss of the core were measured by using a BH analyzer (SY-8258, produced by Iwatsu test instruments corporation) with a frequency of 20 kHz and a magnetic flux density of 50 mT. The results were shown in Table 1.

The content of boron nitride in the soft magnetic metal powder core of each Example and Comparative Example was quantified by the following method. In particular, an ICP was used to measure the content of B in each soft magnetic metal powder core, and a value was calculated by deducting the content of B inside the metal particle constituting each soft magnetic metal powder core from the value obtained above. Further, the content of nitrogen in each powder was tested via an oxygen-nitrogen analyzer (TC600, produced by LECO Corporation). The sum of these two values will be deemed as the content of boron nitride.

TABLE 1

| | Method for preparing starting material powder | Additive amount of B [wt %] | Content of Si [wt %] | Content of Cr [wt %] | Temperature for thermal treatment [° C.] | Time for thermal treatment [min] | Content of B [ppm] | Percentage occupied by particles having roundness of 0.80 or more [%] |
|---|---|---|---|---|---|---|---|---|
| Example 1-1 | water atomization method | 0.4 | 6.5 | 0 | 1100 | 140 | 22 | 19 |
| Example 1-2 | water atomization method | 0.4 | 6.5 | 0 | 1100 | 120 | 64 | 20 |

TABLE 1-continued

| | | | | | | | | |
|---|---|---|---|---|---|---|---|---|
| Example 1-3 | water atomization method | 0.4 | 6.5 | 0 | 1100 | 60 | 150 | 19 |
| Comparative Example 1-4 | water atomization method | 0.4 | 6.5 | 0 | 1100 | 40 | 163 | 22 |
| Comparative Example 1-5 | water atomization method | 0.4 | 6.5 | 0 | 1100 | 20 | 351 | 20 |
| Comparative Example 1-6 | water atomization method | 0.4 | 6.5 | 0 | 1100 | 10 | 1490 | 18 |
| Example 1-7 | water atomization method | 0.1 | 6.5 | 0 | 1100 | 40 | 121 | 18 |
| Example 1-8 | water atomization method | 0.4 | 6.5 | 0 | 1100 | 70 | 119 | 18 |
| Example 1-9 | water atomization method | 1.0 | 6.5 | 0 | 1100 | 240 | 128 | 22 |
| Example 1-10 | water atomization method | 2.0 | 6.5 | 0 | 1100 | 360 | 149 | 21 |
| Comparative Example 1-11 | water atomization method | 3.0 | 6.5 | 0 | 1100 | 600 | 271 | 20 |
| Comparative Example 1-12 | water atomization method | — | 6.5 | 0 | 1100 | 10 | — | — |
| Comparative Example 1-13 | gas atomization method | — | 6.5 | 0 | 1100 | 10 | — | — |
| Example 1-14 | water atomization method | 0.4 | 6.5 | 0 | 1200 | 60 | 100 | 22 |
| Example 1-15 | water atomization method | 0.4 | 6.5 | 0 | 1200 | 60 | 100 | 22 |
| Example 1-16 | gas atomization method | 0.4 | 6.5 | 0 | 1200 | 60 | 102 | 91 |
| Example 1-17 | gas atomization method | 0.4 | 6.5 | 0 | 1200 | 60 | 102 | 91 |
| Example 1-18 | gas atomization method | 0.4 | 6.5 | 0 | 1200 | 80 | 81 | 90 |
| Example 1-19 | gas atomization method | 0.4 | 6.5 | 0 | 1200 | 80 | 81 | 90 |
| Example 1-20 | gas atomization method | 0.4 | 6.5 | 0 | 1200 | 60 | 99 | 92 |
| Example 1-21 | gas atomization method | 0.4 | 6.5 | 0 | 1200 | 60 | 99 | 92 |
| Example 1-22 | gas atomization method | 0.4 | 6.5 | 0 | 1200 | 80 | 80 | 95 |
| Example 1-23 | gas atomization method | 0.4 | 6.5 | 0 | 1200 | 80 | 80 | 95 |
| Example 1-24 | water atomization method | 0.4 | 6.5 | 0 | 1200 | 80 | 80 | 29 |
| Example 1-25 | water atomization method | 0.4 | 6.5 | 0 | 1200 | 80 | 80 | 29 |
| Example 1-26 | water atomization method | 0.4 | 6.5 | 0 | 1200 | 80 | 81 | 20 |
| Example 1-27 | water atomization method | 0.4 | 6.5 | 0 | 1200 | 80 | 81 | 20 |
| Example 1-28 | water atomization method | 0.4 | 6.5 | 0 | 1200 | 60 | 108 | 27 |
| Example 1-29 | water atomization method | 0.4 | 6.5 | 0 | 1200 | 60 | 108 | 27 |
| Example 1-30 | gas atomization method | 0.4 | 6.5 | 0 | 1200 | 80 | 80 | 91 |
| Example 1-31 | gas atomization method | 0.4 | 6.5 | 0 | 1200 | 80 | 80 | 91 |
| Comparative Example 1-32 | water atomization method | — | 6.5 | 0 | 900 | 60 | — | 22 |
| Comparative Example 1-33 | gas atomization method | — | 6.5 | 0 | 900 | 60 | — | 93 |
| Example 1-34 | gas atomization method | 0.4 | 6.5 | 0 | 1200 | 80 | 80 | 95 |

| | Percentage occupied by particles consisting of one single grain each [%] | Content of oxygen [ppm] | Coercivity of powder [A/m] | Treatment for removing boron nitride | Content of boron nitride [ppm] | Permeability | Loss of core a 20 kHz 50 mT [kW/m$^3$] |
|---|---|---|---|---|---|---|---|
| Example 1-1 | 20 | 1630 | 138 | performed | 2250 | 74 | 170 |
| Example 1-2 | 21 | 1668 | 140 | performed | 2290 | 72 | 173 |
| Example 1-3 | 18 | 1654 | 144 | performed | 2300 | 71 | 179 |
| Comparative Example 1-4 | 0 | 1620 | 267 | performed | 2300 | 41 | 372 |
| Comparative Example 1-5 | 0 | 1661 | 403 | performed | 2400 | 31 | 604 |

TABLE 1-continued

| | | | | | | | |
|---|---|---|---|---|---|---|---|
| Comparative Example 1-6 | 0 | 1658 | 510 | performed | 2340 | 27 | 795 |
| Example 1-7 | 18 | 1680 | 143 | performed | 2220 | 73 | 177 |
| Example 1-8 | 19 | 1654 | 142 | performed | 2290 | 73 | 175 |
| Example 1-9 | 22 | 1666 | 144 | performed | 2310 | 68 | 179 |
| Example 1-10 | 15 | 1661 | 146 | performed | 2300 | 68 | 181 |
| Comparative Example 1-11 | 0 | 1655 | 325 | performed | 2300 | 37 | 470 |
| Comparative Example 1-12 | — | — | — | — | — | — | — |
| Comparative Example 1-13 | — | — | — | — | — | — | — |
| Example 1-14 | 81 | 1590 | 131 | none | 5200 | 58 | 160 |
| Example 1-15 | 81 | 1590 | 131 | performed | 2100 | 74 | 160 |
| Example 1-16 | 79 | 551 | 118 | none | 4800 | 49 | 141 |
| Example 1-17 | 79 | 551 | 118 | performed | 1830 | 64 | 141 |
| Example 1-18 | 91 | 530 | 98 | none | 5150 | 53 | 112 |
| Example 1-19 | 91 | 530 | 98 | performed | 1880 | 70 | 112 |
| Example 1-20 | 83 | 52 | 96 | none | 5110 | 54 | 110 |
| Example 1-21 | 83 | 52 | 96 | performed | 1780 | 71 | 110 |
| Example 1-22 | 90 | 63 | 88 | none | 4990 | 58 | 99 |
| Example 1-23 | 90 | 63 | 88 | performed | 1790 | 76 | 99 |
| Example 1-24 | 94 | 1631 | 112 | none | 5180 | 62 | 132 |
| Example 1-25 | 94 | 1631 | 112 | performed | 2170 | 79 | 132 |
| Example 1-26 | 90 | 491 | 98 | none | 5120 | 65 | 112 |
| Example 1-27 | 90 | 491 | 98 | performed | 2210 | 82 | 112 |
| Example 1-28 | 78 | 479 | 111 | none | 5000 | 64 | 130 |
| Example 1-29 | 78 | 479 | 111 | performed | 2050 | 77 | 130 |
| Example 1-30 | 90 | 63 | 88 | performed | 510 | 90 | 99 |
| Example 1-31 | 90 | 63 | 88 | performed | 50 | 128 | 99 |
| Comparative Example 1-32 | 0 | 1710 | 433 | — | — | 40 | 300 |
| Comparative Example 1-33 | 0 | 550 | 334 | — | — | 30 | 250 |
| Example 1-34 | 90 | 63 | 88 | performed | 4790 | 70 | 99 |

A film of boron nitride was formed on the surface of the powder particle in Examples 1-1 to 1-3, Comparative Examples 1-4 to 1-6, Examples 1-7 to 1-10, Comparative Example 1-11, and Examples 1-14 to 1-31. In addition, no combinations between the soft magnetic metal powder particles had been found, and the adhesions could be inhibited even if a thermal treatment at a high temperature had been performed. In Comparative Examples 1-12 and 1-13, as no B was added, no film of boron nitride had been formed so that the metal particles adhered to each other after the thermal treatment at a high temperature and powder cannot be obtained. Compared to Comparative Examples 1-4 to 1-6 and 1-11, it was confirmed in Examples 1-1 to 1-3 and 1-7 to 1-10 that the grain size of the soft magnetic metal powder particle became larger and grains did had grown. Although bulks were found in Comparative Examples 1-12 and 1-13 instead of powders, the grain size was found to be even smaller than that in Examples 1-1 to 1-3 and 1-7 to 1-10. All these showed that the growth of grains was promoted if the content of B inside the metal particle of the soft magnetic metal powder was 10 to 150 ppm. In addition, the coercivity of the powder was lowered in Examples 1-1 to 1-3 and 1-7 to 1-10 compared that in Comparative Examples 1-4 to 1-6 and 1-11. Further, when the content of B inside the metal particle of the soft magnetic metal powder was controlled to be 10 to 150 ppm, an effect of promoting the growth of grains will be found due to the diffusion of the trace of B. Also, it could be seen from Examples 1-14 to 1-29 that the coercivity decreased in the following cases, that were, if the percentage occupied by metal particles with the cross-section having a roundness of 0.80 or more was 90% or more; or 90% or more of the metal particles constituting the soft magnetic metal powder consisted of one single grain each; or the content of oxygen contained in the soft magnetic metal powder was 500 ppm or less. When the permeability in the magnetic core was compared, if the processes other than the grinding treatment to the film of boron nitride were the same, the permeability became larger when the film of boron nitride had been subjected to the grinding treatment. It can be known from the comparisons among Examples 1-22, 1-23, 1-30, 1-31 and 1-34 that the less the content of boron nitride was in the soft magnetic metal powder core, the larger the coercivity was. In Comparative Examples 1-32 and 1-33, the temperature during the high-temperature thermal treatment was as low as 900° C., so the coercivity was large. If the loss of the core was compared among Examples 1-1 to 1-3, 1-7 to 1-10 and 1-14 to 1-31 and Comparative Examples 1-4 to 1-6, 1-11 to 1-13, 1-32 and 1-33, it would be known that the loss of the core can be reduced in the soft magnetic metal powder core which used the soft magnetic metal powder of the present invention.

Example 2

Content of Si and Content of Cr in Soft Magnetic Metal Powder

A starting material powder was prepared via the water atomization method with the amount of Si and Cr being those as shown in Table 2 and the additive amount of B being 0.2 mass %. The particle size of the starting material powder was adjusted by a sieving process to have the average particle size controlled to be 20 μm. The powder was filled in a crucible made of alumina which was later put into a tube furnace and subjected to a thermal treatment at a high temperature of 1100° C. under the nitrogen atmosphere for 60 minutes. The content of B inside the metal particle of the obtained soft magnetic metal powder was qualified by the ICP in the same process as that in Example 1 (Examples 2-2 to 2-7 and 2-9 to 2-13 and Comparative Examples 2-1 and 2-8).

The coercivity of the powder was measured for each Example and Comparative Example. The measurement was performed in the same process as that in Example 1, and the results were shown in Table 2.

The test on rust prevention was done for each Example and Comparative Example. The powder was fixed by cold mounting and embedding resin, and then cross-sections were cut and then mirror polished. The sample was placed in a constant temperature and humidity cabinet at 60° C. with a relative humidity of 95% for 2000 hours. Thereafter, 20 cross-sections of the metal particles were randomly observed, and the percentage occupied by the rusty metal particles was calculated. The results were shown in Table 2.

TABLE 2

| | Preparation method | Additive amount of B [wt %] | Content of Si [mass %] | Content of Cr [mass %] | Content of B [ppm] | Coercivity of powder [A/m] | Percentage occupied by rusty particles [%] |
|---|---|---|---|---|---|---|---|
| Comparative Example 2-1 | water atomization method | 0.2 | 0.5 | 0 | 97 | 230 | 85 |
| Example 2-2 | water atomization method | 0.2 | 1.0 | 0 | 98 | 190 | 30 |
| Example 2-3 | water atomization method | 0.2 | 3.0 | 0 | 93 | 162 | 25 |
| Example 2-4 | water atomization method | 0.2 | 4.5 | 0 | 101 | 147 | 25 |
| Example 2-6 | water atomization method | 0.2 | 10 | 0 | 103 | 150 | 20 |
| Example 2-7 | water atomization method | 0.2 | 15 | 0 | 98 | 169 | 20 |
| Comparative Example 2-8 | water atomization method | 0.2 | 18 | 0 | 98 | 210 | 20 |
| Example 2-9 | water atomization method | 0.2 | 4.5 | 0.5 | 106 | 148 | 20 |
| Example 2-10 | water atomization method | 0.2 | 4.5 | 1.0 | 98 | 149 | 0 |
| Example 2-11 | water atomization method | 0.2 | 4.5 | 5.0 | 104 | 151 | 0 |
| Example 2-12 | water atomization method | 0.2 | 4.5 | 10 | 99 | 153 | 0 |
| Example 2-13 | water atomization method | 0.2 | 4.5 | 12 | 92 | 159 | 0 |

The coercivity was sufficiently small in Examples 2-2 to 2-7 while the coercivity was increased in Comparative Examples 2-1 and 2-8. Compared to the composition of the metal powder in Example 2-4, Cr was additionally added in the metal powder of Examples 2-9 to 2-13. It can be seen from the comparison that the coercivity of the powder would not be affected even Cr was added. In addition, the percentage occupied by rusty particles became 0% by adding 1.0 mass % or more of Cr.

As described above, the soft magnetic metal powder of the present invention has a low coercivity. When this soft magnetic metal powder is used to prepare a soft magnetic metal powder core, a core having a low loss can be obtained. Since the soft magnetic metal powder and the soft magnetic metal powder core have low losses, a high efficiency will be provided. Therefore, they can be widely and efficiently used in electromagnetic devices such as a power supply or the like.

DESCRIPTION OF REFERENCE NUMERALS

1. starting material powder particle
2. $Fe_2B$ phase
3. Bin parent phase
4. grain boundary
5. soft magnetic metal powder particle
6. film of boron nitride

What is claimed is:

1. A soft magnetic metal powder, comprising metal particles that include Fe, as a main component, Si, and B, wherein, the content of Si in the soft magnetic metal powder is 1 to 15 mass %, the content of B inside the metal particles of the soft magnetic metal powder is 22 to 150 ppm, and a surface of the metal particles comprises a film of boron nitride.

2. The soft magnetic metal powder of claim 1, wherein, the content of Cr in the soft magnetic metal powder is 1 to 10 mass %.

3. The soft magnetic metal powder of claim 1, wherein, the roundness of the cross-section is 0.80 or more in 90% or more of the metal particles.

4. The soft magnetic metal powder of claim 1, wherein, 90% or more of the metal particles consists of one single grain.

5. The soft magnetic metal powder of claim 1, wherein, the content of oxygen contained in the soft magnetic metal powder is 500 ppm or less.

6. A soft magnetic metal powder core which is prepared by using the soft magnetic metal powder of claim 1.

7. A soft magnetic metal powder core which is prepared by using the soft magnetic metal powder of claim 1, wherein, the content of the boron nitride in the soft magnetic powder cor is 50 to 4790 ppm.

* * * * *